US007699093B2

(12) United States Patent
Wanni et al.

(10) Patent No.: US 7,699,093 B2
(45) Date of Patent: Apr. 20, 2010

(54) ANTI-VIBRATION TUBE SUPPORT FOR TUBE BUNDLES HAVING U-SHAPED BENDS

(75) Inventors: Amar S. Wanni, Falls Church, VA (US); Thomas M. Rudy, Warrenton, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 155 days.

(21) Appl. No.: 11/543,869

(22) Filed: Oct. 6, 2006

(65) Prior Publication Data

US 2007/0089856 A1 Apr. 26, 2007

Related U.S. Application Data

(60) Provisional application No. 60/728,327, filed on Oct. 20, 2005.

(51) Int. Cl.
*F28D 7/00* (2006.01)

(52) U.S. Cl. ..... 165/69; 165/162; 248/68.1

(58) Field of Classification Search ..... 165/69, 165/162, 165, 172; 248/68.1; 138/106, 107, 138/112, 115–117
See application file for complete search history.

(56) References Cited

U.S. PATENT DOCUMENTS 1,738,848 A * 12/1929 Starr ..... 165/162
2,317,572 A 4/1943 Whitt et al.
2,853,278 A 9/1958 Hesler
3,007,679 A * 11/1961 Byerley et al. ..... 165/176
3,212,567 A 10/1965 Romanos
3,575,236 A 4/1971 Romanos
3,715,275 A 2/1973 Krawiec
3,933,583 A 1/1976 Jabsen
4,160,477 A 7/1979 Roffler
4,175,003 A * 11/1979 Beuchel et al. ..... 376/442
4,359,088 A 11/1982 Jabsen
4,570,703 A * 2/1986 Ringsmuth et al. ..... 165/162
4,594,216 A 6/1986 Feutrel
4,648,442 A 3/1987 Williams
4,781,884 A 11/1988 Anthony
4,860,697 A * 8/1989 Malaval ..... 165/162
4,919,199 A 4/1990 Hahn (Continued)

FOREIGN PATENT DOCUMENTS

EP 0300845 A1 1/1989

(Continued)

OTHER PUBLICATIONS

International Search Report, PCT Application No. PCT/US2006/040422, Feb. 22, 2007.

*Primary Examiner*—Teresa J Walberg
(74) *Attorney, Agent, or Firm*—Glenn T. Barrett

(57) ABSTRACT

A tube support device for a tube bundle having a plurality of elongated tubes with a U-shaped bend portion is disclosed. The tube support device includes an elongated longitudinally extending strip having a pair of opposing faces. A plurality of tube engaging members extend from the pair of opposing faces. The tube support device includes an engagement assembly formed on one end of the tube support device. The engagement assembly is adapted to engage the anchor assembly positioned within the tube bundle, whereby the tube support device can be rotated into the desired orientation between the tubes to prevent vibration damage.

24 Claims, 5 Drawing Sheets

U.S. PATENT DOCUMENTS

| | | | | | |
|---|---|---|---|---|---|
| 5,072,786 | A | * | 12/1991 | Wachter | 165/69 |
| 5,213,155 | A | | 5/1993 | Hahn | |
| 5,553,665 | A | | 9/1996 | Gentry | |
| 5,570,739 | A | | 11/1996 | Krawchuk et al. | |
| 6,401,803 | B1 | | 6/2002 | Hahn | |
| 2005/0006075 | A1 | | 1/2005 | Wanni et al. | |

FOREIGN PATENT DOCUMENTS

| | | | |
|---|---|---|---|
| EP | 0544579 | A1 | 6/1993 |
| EP | 0633427 | A1 | 1/1995 |
| JP | 60235998 | | 11/1985 |
| WO | WO 2006/057967 | A1 | 6/2006 |

* cited by examiner

ANTI-VIBRATION TUBE SUPPORT FOR TUBE BUNDLES HAVING U-SHAPED BENDS

CROSS REFERENCE TO RELATED APPLICATIONS

This application relates to and claims priority to U.S. Provisional Patent Application No. 60/728,327 to Wanni et al., filed on Oct. 20, 2005 and entitled "Anti-Vibration Tube Support for Tube Bundles having U-shaped Bends." The disclosure is incorporated herein specifically by reference.

FIELD OF THE INVENTION

This invention relates to tube supports devices, commonly referred to as tube stakes. The tube support devices are installed to control flow-induced vibration and prevent movement of the tubes or rods within a tube bundle. Specifically, the present invention relates to a tube support device to be installed in the portion of the tube bundle wherein the elongated tubes have U-bends whereby the flow direction within the tubes is reversed. The present invention is useful with tube or rod bundles in heat exchangers, steam generators and similar fluid-handling equipment. It is contemplated that the present invention may be used in any application where vibration caused by fluid flow across a pattern of elongated members (tubes, pipes, rods, etc.) presents a problem.

BACKGROUND OF THE INVENTION

Tube bundle equipment such as shell and tube heat exchangers and similar items of fluid handling devices utilize tubes organized in bundles to conduct the fluids through the equipment. In such tube bundles, there is typically fluid flow both through the insides of the tubes and across the outsides of the tubes. The configuration of the tubes in the bundle is set by the tube sheets into which the tubes are set. One common configuration for the tubes is the rectangular formation with the tubes set in aligned rows with tube lanes (the straight paths between the tubes) between each pair or rows, aligned orthogonally to one another. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent six other tubes (the two adjacent tubes in the same row and four tubes in the two adjacent rows). The tubes contained in the tube bundles will extend in a longitudinal direction along one side of the tube bundle to one end. The tube will then have a U-shaped bend portion such that the tube can extend in a longitudinal direction along an opposite side of the tube bundle. The U-shaped bend portion will typically extend around an anchor assembly located within the tube bundle.

Fluid flow patterns around the tubes as well as the changes in the temperature and density of the fluids which arise as they circulate as a result of the heat exchange between the two fluids flowing in and around the tubes may give rise to flow-induced vibrations of an oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without heat transfer taking place.

Besides good equipment design, other measures may be taken to reduce tube vibration. Tube support devices or tube stakes as these support devices are commonly known (and referred to in this specification) may be installed in the tube bundle in order to control flow-induced vibration and to prevent excessive movement of the tubes. A number of tube supports or tube stakes have been proposed and are commercially available. One type, described in U.S. Pat. No. 4,648,442 to Williams has a U-shaped configuration in which the distance between the top and bottom surfaces of the channel is the same as the distance between adjacent rows in the tube bundle (i.e. is substantially the same as the tube lane dimension). This type of stake is inserted between the rows in the bundle and is secured at end by an arcuate segment which engages a segment of a tube at the periphery of the tube bundle so as to lock the stake in place in its appropriate position between the rows in the bundle.

Another form of anti-vibration tube stake is described in U.S. Pat. No. 4,919,199 to Hahn, which discloses a stake made in a soft V-configuration strip in which saddles are formed perpendicular to the longitudinal axis of the strip in the open ends of these V-shaped cross sections. The saddles are formed in the strip with a pitch (distance between saddles) equal to the tube pitch and with a radius which matches that of the tubes in the tube bundle so the saddles engage with the tubes on one side of the tube lane. The engagement between these tubes and the saddles locks the tube into place in the tube bundle. The resilient nature of the strip, coupled with the spring type action provided by the V-configuration permits the arms of the V to open and reduce the effective overall width of the stake enables the stake to engage the tubes on both sides of a tube lane in so that the V-shaped stake is locked into place between the two rows of tubes.

A similar type of tube stake is described in U.S. Pat. No. 5,213,155 to Hahn which discloses a U-shaped stake which is inserted between two tube lanes with the closed end of the U over one of the peripheral tubes in the bundle. Saddles are formed in the open ends of the V-shaped cross section to engage with opposite sides of the tubes in a single row in the bundle. The U-shaped stake is fastened in place around the tubes of the bundle by suitable fasteners extending between the two arms of the stake.

One problem with the pressed configuration of the type shown in U.S. Pat. No. 4,648,442 is that the stakes do not create a positive location for each individual tube, although the stake is locked into place in its selected tube lane. The tubes remain free to vibrate in one plane parallel to the tube lane and parallel to the stake. A different problem exists with the design shown in U.S. Pat. No. 5,213,155: although the tubes in rows encircled by the U-shaped stakes are fully supported, the tubes at the periphery of the tube bundle which are not directly encircled by one of the stakes i.e., retained within one of the closed ends of the U-shaped stakes (these are the outer tubes in alternate rows which are not encircled by the ends of the U-shaped stakes), are free to move and vibration in these tubes can be expected under certain conditions. In addition, because the corrugation of the tube support has a transition region before reaching its full depth the two tubes adjacent to each of the outermost tubes do not receive any vibration mitigation either.

One disadvantage of the stake designs which use channel pressings to accommodate the distance between the tubes forming a single tube lane is that deep channel pressings are required or other measures necessary when the tube lane is relatively wide. A more complicated form of tube support is shown in U.S. Pat. No. 6,401,803 to Hahn. This stake uses two V-shaped pressings separated by compression springs which force the stakes against the tubes on opposite sides of the tube lane in order to dampen oscillatory vibrations. This form of stake is, however, quite expensive to manufacture. A unitary stake which will accommodate relatively wide tube lanes without the complication of separate parts therefore remains desirable.

Another disadvantage of these stake designs is that these designs are not well suited for reducing vibration in the portion of the tube bundle containing the U-shaped bend portion of the elongated tubes. These designs do not permit the manipulation of the stake such that it can be properly oriented within the tube bundle to reduce or prevent vibration of the tubes in the U-shaped bend portion.

SUMMARY OF THE INVENTION

It is an aspect of the present invention to provide a tube support device for a tube bundle having a plurality of elongated tubes. The plurality of elongated tubes are arranged in rows of elongated members. Each elongated tube is substantially U-shaped such that the elongated tube extends along one side of the tube bundle anchor assembly and along another side of the tube bundle. Each tube has a pair of elongated linear portions joined by a U-shaped bend portion. The tube support device includes an elongated longitudinally extending strip having a pair of opposing faces. A plurality of tube engaging members extends from the pair of opposing faces. It is contemplated that the tube engaging members may be formed as dimples, corrugations or other suitable projection that this capable of engaging the tubes extending along opposing sides of the strip. The tube support device in accordance with the present invention is sized to be located between adjacent rows of elongated tubes in the U-shaped bend portion.

In accordance with the present invention, the tube support device further includes an engagement assembly formed on one end of the tube support device. The engagement assembly is configured to engage an anchor assembly provided adjacent the geometric center of the U-bend region of the tube bundle, which secures the tube support device to the anchor assembly and the tube bundle. The anchor assembly is inserted within the tubes. The ends of the anchor assembly may be clamped to one or more of the outer tubes of the bundle to maintain the anchor assembly in place. The anchor assembly may take the form of a bar or a cable. With such an arrangement, the engagement assembly can be partially rotated or pivoted about the axis of the anchor assembly such the tube support device can be rotated into the desired orientation between the tubes to prevent vibration. The engagement assembly may include an aperture formed in one end of the strip. The aperture is sized to preferably receive the anchor assembly therein. There may be instances where insufficient clearance exists between the tubes such that the support device cannot be inserted fully into the bundle to contact the anchor assembly. The engagement assembly having an aperture is particularly suited for new tube bundles where the tube support device can be secured to the anchor assembly during the assembly of the tube bundle. The engagement assembly may alternatively include a slot formed in one end of the strip. Like the aperture, the slot is sized to receive the anchor assembly therein. The slot arrangement can be used in both new tube bundles and retrofitted existing tube bundles. The slot permits the engagement of the tube support device with the anchor assembly such that the tube support device can be rotated about the anchor assembly into the desired location. The slot may have a tapered open end to facilitate insertion of the anchor assembly into the slot.

In accordance with aspects of the present invention, the engagement assembly may be formed as part of the elongated strip or as part of an extension that is secured to an end of the strip. When formed as a part of the strip, the engagement assembly may be formed in the end portion thereof. It is contemplated that in order to increase the stability of the engagement between the tube support device and the anchor, the thickness of the end of the tube support device may be increased. This may be accomplished by folding the end of the strip over onto itself or other suitable means including laminating additional layers of material to the end portion of the strip.

In accordance with another aspect of the present invention, a tube bundle device employing the above-described tube support device is disclosed. The tube bundle device includes a tube bundle having a plurality of elongated tubes. An anchor assembly, which takes the form of either a cable or a bar may be located between the inner tubes of the bundle. It is contemplated that the plurality of elongated tubes are arranged in rows with elongated tube having a substantially U-shaped configuration. The tubes have a first elongated tube portion that extends along one side of the tube bundle, a U-bend portion that extends over an anchor assembly, and a second elongated portion that extends along another side of the tube bundle. The tube support devices are configured to be located within the spaces between the U-bend portions such that the engagement assembly engages the anchor assembly.

In accordance with another aspect of the present invention, the tube bundle device is a heat exchanger. The present invention, however, is not intended to be so limited; rather, it is contemplated that the present invention may be used in connection with other device having bundles of tubes containing a U-shaped bend portion with or without an anchor assembly. These devices include but are not limited to steam generators and other similar fluid-handling equipment.

Another aspect of the present invention is to provide a method of reducing vibration in a heat exchanger or other device having a tube bundle. At least one tube support device is located within the space between adjacent rows of elongated tubes near the U-shaped bend portion of the tubes. The tube support device engages the anchor assembly of the tube bundle. Each tube support device is rotated about the axis of the anchor assembly such that tube support device can be rotated to the desired orientation within the U-shaped bend portion to provide the necessary support of the tubes to reduce and/or eliminate any vibration.

BRIEF DESCRIPTION OF THE DRAWINGS

The invention will now be described in connection with the following drawing in which like reference numerals designate like elements and wherein.

DETAILED DESCRIPTION OF PREFERRED EMBODIMENTS

Figure 1:
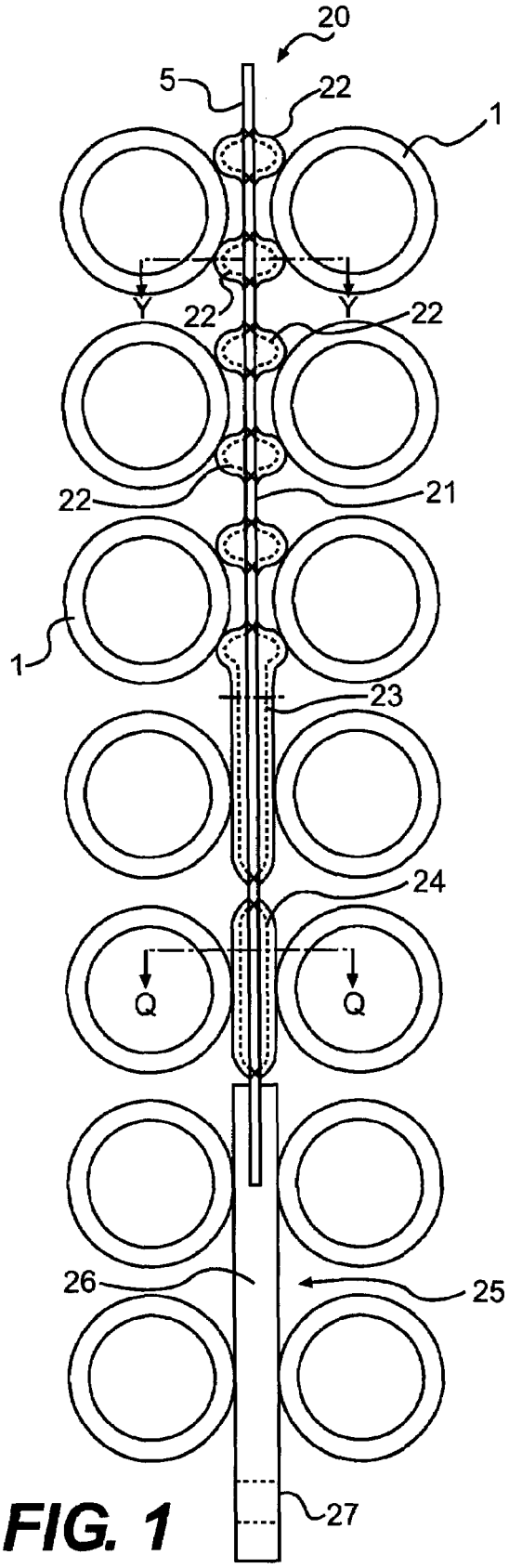
FIG. 1 is a cross-sectional view of a tube support device having an engagement assembly for engaging an anchor assembly in accordance with an embodiment of the present invention.
Figure 2:
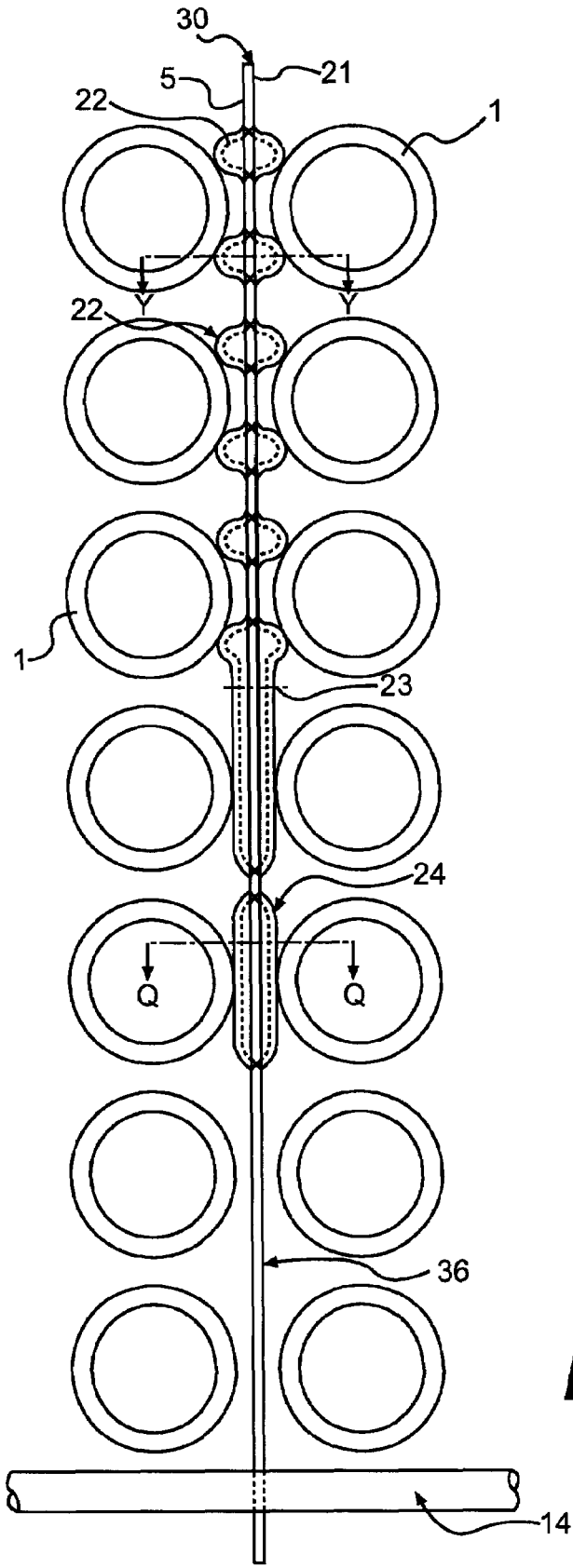
FIG. 2 is a cross-sectional view of a tube support device having an engagement assembly for engaging an anchor assembly in accordance with another embodiment of the present invention.
Figure 13:
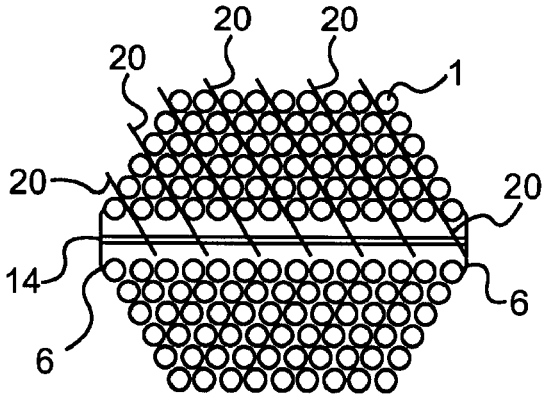
FIG. 13 is a schematic view illustrating the positioning of the tube support device located in a tube bundle having a triangular configuration.
Figure 11:
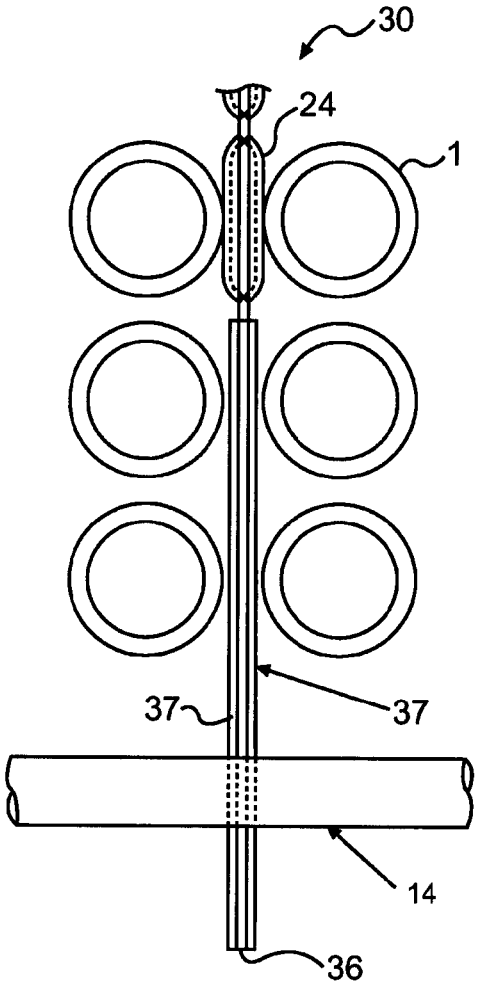
FIG. 11 is a side a view of a variation of the engagement assembly of the embodiment shown in FIG. 2.
Figure 14:
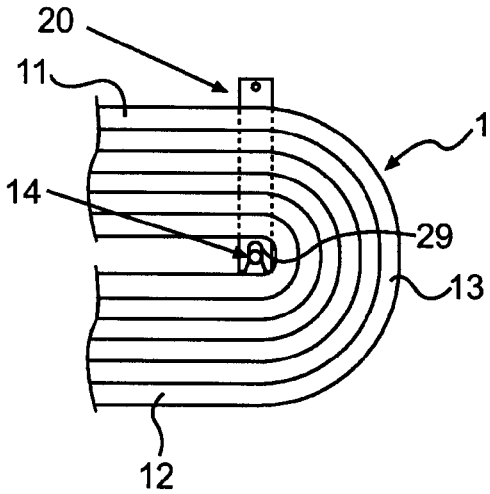
FIG. 14 is a schematic view illustrating the positioning of the tube support device within a tube bundle at the time of insertion of the tube support device in the tube bundle.
Figure 15:
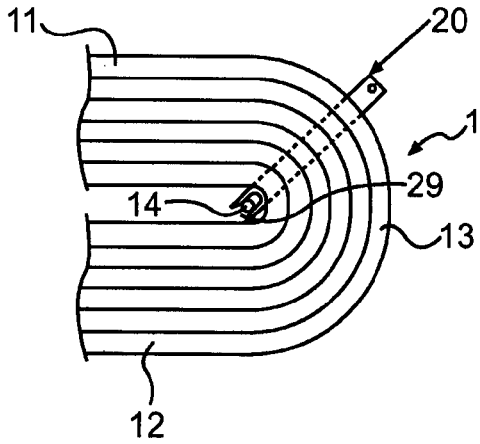
FIG. 15 is a schematic view illustrating one possible position of the tube support device within the tube bundle after the tube support device is rotated to a desired location.

The heat exchanger includes an array of elongated tubes or rods 1 arranged in a bundle. As shown in FIGS. 14 and 15, each tube or rod 1 preferably includes a first elongated linear section 11 that extends along one side of the bundle. A second elongated linear section 12 extends along an opposite side of the bundle. A U-shaped bend portion 13 interconnects sections 11 and 12. The tubes 1 may be arranged in a rectangular configuration, as shown in FIGS. 1, 2 and 11 or a triangular configuration, as shown in FIG. 13. An anchor assembly 14 extends through the bundle adjacent the U-shaped bend portion 13, as shown in FIGS. 14 and 15. The inner tubes 1 (i.e., those tubes or rods that are located closest to the anchor assembly 14) are generally much stiffer than the tubes 1 that are located near the exterior of the bundle. The outer tubes are more susceptible to vibration and chatter. The anchor assembly 14 is inserted into the bundle prior to insert of the tube support devices, described below. The anchor assembly 14 may take the form of a bar or a cable that is clamped to one or more of the outer tubes 1 of the bundle, as shown in FIG. 13, using an appropriate clamp 6.

The tube support device or stake of the present invention is arranged to provide direct support for elongated tubes, rods, pipes or the like that are adjacent to one another but separated by a space in the bundle. The elongated tubes may be separated by a defined tube lane or spacer lane or a less defined space. The less defined space may occur when the tube support is retrofit into an existing bundle of tubes where warping or deformation of the tubes or rods may have occurred. While the present invention is described in connection with tubes, it is not intended that the present invention be used solely with cylindrical, hollow tubes. It is intended that the present invention may be used in with hollow or solid rods or tubes. Furthermore, the tubes are not limited to a circular cross section; rather, it is intended that the tubes or rods may be square, triangular or have any other suitable configuration. The overall length of the tube support device may vary based on the size of the tube bundle and how well the space or spacer lane between adjacent elongated members or tubes is defined.

Figure 3:
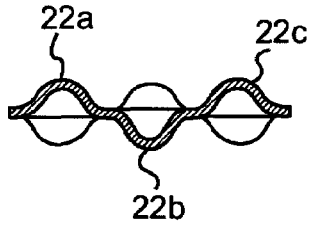
FIG. 3 is cross-sectional view of the tube support device taken along Y-Y in FIGS. 1 and 2.
Figure 4:
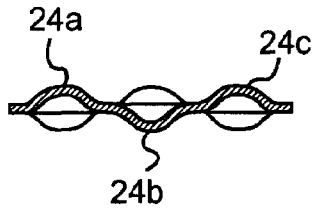
FIG. 4 is a cross-sectional view of the tube support device taken along Q-Q in FIGS. 1 and 2.

A tube support device 20 in accordance with an embodiment of the present invention will now be described in connection with FIGS. 1, and 3-6. The tube support device 20 includes an elongated strip 21. The elongated strip 21 is preferably formed from a strip of metal (e.g., stainless steel), which will resist corrosion. The elongated strip 21 includes a plurality of rows of tube engaging members 22, 23, and 24. The tube engaging members may includes rows of dimples 22*a*, 22*b*, 22*c*, as shown in FIGS. 1 and 3, which project from opposing sides of the strip 21. The tube engaging members may also include rows of elongated corrugations 24*a*, 24*b*, 24*c*, as shown in FIGS. 1 and 4, which project from opposing side of the strip 21. Furthermore, the tube engaging member may include members 23, which include both dimples and corrugations, as shown in FIG. 1. These arrangements are disclosed in greater detail in U.S. patent application Ser. No. 10/848,903, filed on May 19, 2004 to Wanni et al., entitled "Anti-Vibration Tube Supports," the disclosure of which is incorporated herein specifically by reference. In each row of tube engaging members, at least one tube engaging members extends from each face of the strip 21 to engage an adjacent tube 1, as shown in FIG. 1. The dimensions of the tube engaging members may vary. For example, the overall height of the tube engaging members may be reduced for the inner tubes in the bundle because these tubes tend to be stiffer. It is contemplated that the tube engaging members may have various configurations provided that the tube engaging members are sized and shaped to contact at least one adjacent tube.

The present invention is not intended to be limited to the tube engaging members illustrated in the figures; rather, other forms of tube engaging members are considered to be well within the scope of the present invention including but not limited to laterally extending corrugations, as taught for example in U.S. patent application Ser. No. 11/253,815, filed on Oct. 20, 2005 to Rudy et al, entitled "Anti-Vibration Tube Support" and U.S. Provisional Patent Application No. 60/630,010, filed on Nov. 22, 2004, entitled "Anti-Vibration Tube Support," the disclosures of which are incorporated specifically herein by reference. While the figures illustrate the tube engaging members extending substantially along the entire length of the strip 21. The present invention is not intended to be so limited; rather, it is contemplated that the strip 21 may contain portions that do not contain any tube engaging members, as disclosed for example in U.S. patent application Ser. No. 11/253,816, filed on Oct. 20,2005 to Wanni et al, entitled "Anti-Vibration Tube Support," the disclosure of which is incorporated specifically herein by reference. When no tube engaging members are present, the thickness of the strip 21 is such that the strip 21 contacts the adjacent tubes 1 to provide the necessary support and deflection to eliminate vibration and chatter.

Figure 5:
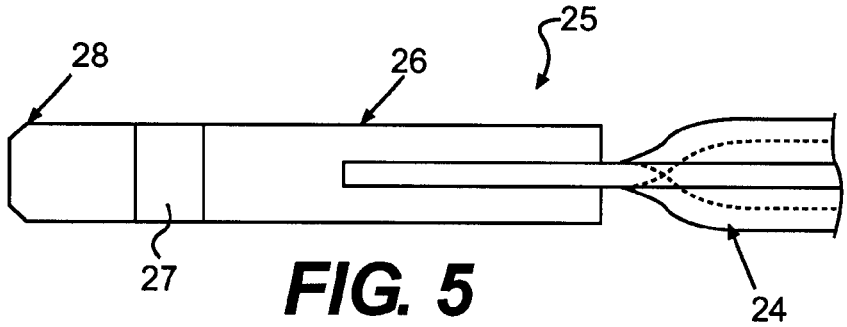
FIG. 5 is a side view of the engagement assembly of the embodiment shown in FIG. 1.
Figure 6:
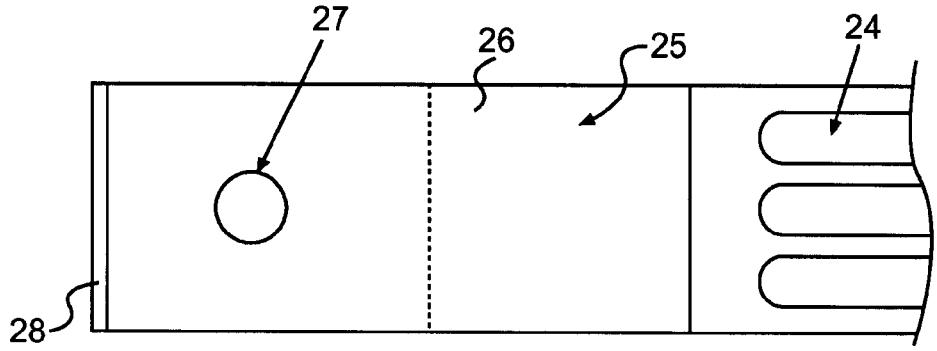
FIG. 6 is a front view of the engagement assembly of the embodiment shown in FIG. 1.
Figure 7:
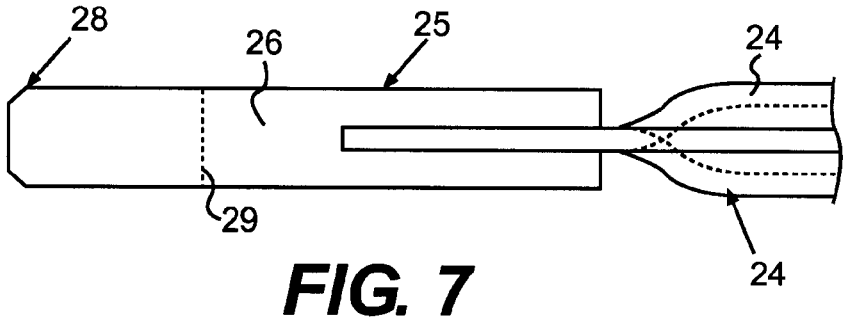
FIG. 7 is a side view of a variation of the engagement assembly of the embodiment shown in FIG. 1.
Figure 8:
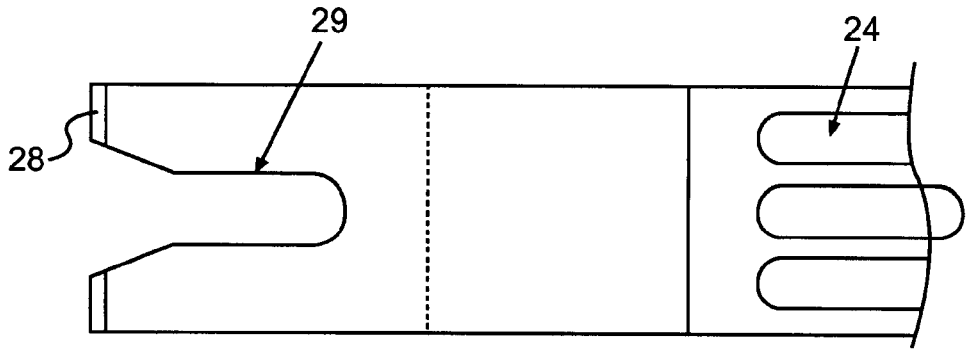
FIG. 8 is a front view of the engagement assembly shown in FIG. 7.

The tube support device 20 includes an engagement assembly 25. The engagement assembly 25 includes a flat bar 26 that is affixed to the end of the strip 21. The bar 26 may be affixed to the strip 21 by welding, or the use of rivets or other suitable fasteners. Like the strip 21, the flat bar 26 is formed from a material that is resistant to corrosion. The flat bar 26 has a thickness that is preferably substantially the same as the spacing between the tubes 1. The flat bar 26 includes an aperture 27 formed therein, as shown in FIGS. 5 and 6. The aperture 27 is sized to receive the anchor assembly 14, as shown in FIG. 2. Engagement of the flat bar 26 with the anchor assembly 14 though the aperture 27 secures the support device 20 to the bundle. The flat bar 26 has a tapered end 28 to facilitate the location or insertion of the support device 20 between the tubes 1. A variation of the flat bar 26 is illustrated in FIGS. 7 and 8. The aperture 27 is replaced with a slot 29. As shown in FIG. 8, the slot 29 has an open end adjacent the end of the flat bar. The open end preferably has an outward taper to aid in the locating of the support device 20 on the anchor assembly 14.

The engagement assembly 25 having aperture 27 is well suited for new bundles where the support device 20 can be secured to the anchor assembly 14 during the assembly of the bundle. While the engagement assembly having a slot 29 is also well suited for new bundles, the slot 29 is also suited for retrofitting existing bundles. As shown in FIG. 14, the tube support device 20 is preferably inserted into the bundle at a location adjacent to the tangent point of the U-shaped bend portion 13. The engagement assembly 25 is engaged with the anchor assembly 14. The tube support device 20 is then rotated about the axis of the anchor assembly 14 to a desired location, as shown for example in FIG. 15, such that tubes 1 deflect a desired distance to eliminate vibration and/or chatter. In this manner, multiple support devices 20 can be inserted between the tubes 1, as shown for example in FIG. 13.

During the insertion operation, a rigid spacer bar may used to temporarily separate the adjacent tubes 1 such that the support device 20 can be inserted between the tubes 1. Once the support device 20 is inserted, the spacer bar can be removed.

A tube support device 30 in accordance with another embodiment of the present invention will now be described in connection with FIGS. 1, 3 and 4. The tube support device 30 includes an elongated strip 21. The elongated strip 21 is preferably formed from a strip of metal (e.g., stainless steel), which will resist corrosion. Like the support device 20, the support device 30 includes a plurality of rows of tube engaging members 22, 23, and 24. The tube engaging members may include rows of dimples 22*a*, 22*b*, 22*c*, as shown in FIGS. 2 and 3, which project from opposing sides of the strip 21. The tube engaging members may also include rows of elongated corrugations 24*a*, 24*b*, 24*c*, as shown in FIGS. 2 and 4, which project from opposing side of the strip 21. Furthermore, the tube engaging member may include members 23, which include both dimples and corrugations, as shown in FIG. 2.

Figure 12:
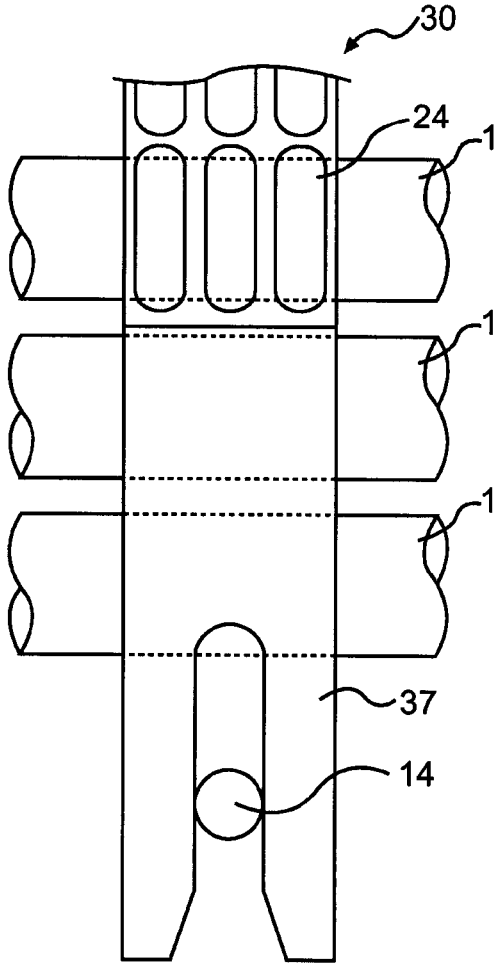
FIG. 12 is a front view of the engagement assembly shown in FIG. 11.

The support device 30 differs from the support device 20 because the engagement assembly is integrated into the strip 21. Instead of securing a flat bar 26, the extension which forms the engagement assembly is formed from an extension 36 of the strip 21. The extension 36 may include an aperture, as shown in FIG. 2. It is also contemplated that the extension 36 may include a slot, as shown in FIG. 12 and discussed above in connection with support device 20. The support device 30 is inserted in a manner similar to that described above in connection with support device 20.

In order to increase the thickness of the extension 36 such that the thickness is substantially the same as the spacing between the tubes 1, additional plates 37 may be added to opposing sides of the extension 36, as shown in FIGS. 11 and 12. The extension 36 and plates 37 may be welded together or joined using rivets or other suitable fasteners.

Figure 9:
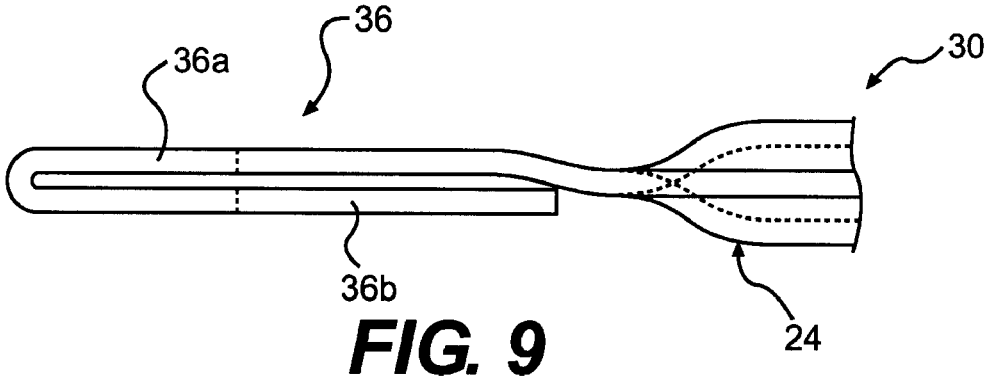
FIG. 9 is a side a view of a variation of the engagement assembly of the embodiment shown in FIG. 2.
Figure 10:
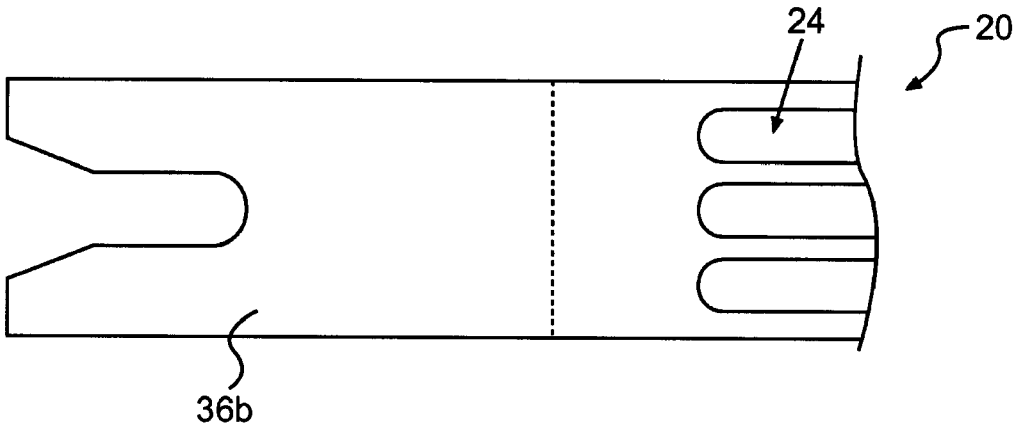
FIG. 10 is a front view of the engagement assembly shown in FIG. 9.

The thickness of the extension 36 may also be increased by folding over the end of the strip 21, as shown in FIG. 9. It is contemplated that the thickness and stiffness may be further increased by inserting a plate between the folded portions 36*a*and 36*b*of the extension 36. The folded extension may include an aperture or a slot for securing the extension 36 to the anchor assembly 14.

The embodiments disclosed herein are well suited for both rectangular and triangular tube configurations. The tube support devices are also well suited for use in bundles having 30 degree, 45 degree, 60 degree and 90 degree layouts.

The tube support devices 20 and 30 may include an aperture 5 formed in one end thereof. A metal band or cable may be inserted through the aperture 5 to secure the outer portion of the support devices to the bundles.

It will be apparent to those skilled in the art that various modifications and/or variations may be made without departing from the scope of the present invention. Thus, it is intended that the present invention covers the modifications and variations of the tube support devices, provided they come within the scope of the appended claims and their equivalents.

What is claimed is:

1. A tube support device for a tube bundle having a plurality of elongated tubes, wherein the plurality of elongated tubes are arranged in rows of elongated members, and an anchor assembly, the tube support device comprising:

an elongated longitudinally extending generally planar strip having a pair of opposing faces;

a plurality of tube engaging members extending from the pair of opposing faces, wherein the tube support device is sized such that the support device is located between adjacent rows of elongated tubes, wherein the plurality of tube engaging members includes a plurality of successive transverse tube support rows located at successive longitudinal locations along the strip, wherein each tube support row having a plurality of raised, tube-engaging zones, wherein at least two of the plurality of raised, tube-engaging zones extend laterally outwards from one of the pair of opposing faces and at least one of the plurality of raised, tube-engaging zones extends laterally outwards from another one of the pair of opposing faces, wherein the plurality of raised, tube-engaging zones extend laterally outwards to engage with tubes in the tube bundle on opposite sides of a tube lane, wherein at least one tube in the tube bundle is engaged by at least one raised tube engaging zone of each of at least two tube support rows of the tube support device, wherein only the raised, tube-engaging zones of the tube engaging members engage the tubes; and an engagement assembly formed on one end of the tube support device, wherein the engagement assembly is adapted to selectively engage the anchor assembly within the tube bundle.

2. The tube support device according to claim 1, wherein the anchor assembly having an anchor assembly axis, wherein the engagement assembly secures the tube support device to the anchor assembly while permitting the tube support device be rotated at least partially around the anchor assembly axis.

3. The tube support device according to claim 1, wherein the engagement assembly comprising an aperture formed in one end of the strip, wherein the aperture being sized to receive the anchor assembly therein.

4. The tube support device according to claim 1, wherein the engagement assembly comprising a slot formed in one end of the strip, wherein the slot being sized to receive the anchor assembly therein.

5. The tube support device according to claim 4, wherein the slot having an open end, wherein the open end is tapered to facilitate insertion of the anchor assembly into the slot.

6. The tube support device according to claim 1, wherein the engagement assembly is formed in one end of the strip.

7. The tube support device according to claim 6, wherein the strip adjacent the one end is folded over onto itself to form an area of increased thickness, wherein the engagement assembly is formed in the area of increased thickness.

8. The tube support device according to claim 1, further comprising an extension secured to the strip, wherein the engagement assembly is formed in the extension.

9. The tube support device according to claim 8, wherein the engagement assembly comprising an aperture formed in one end of the extension, wherein the aperture being sized to receive the anchor assembly therein.

10. The tube support device according to claim 8, wherein the engagement assembly comprising a slot formed in one end of the extension, wherein the slot being sized to receive the anchor assembly therein.

11. The tube support device according to claim 10, wherein the slot having an open end, wherein the open end is tapered to facilitate insertion of the anchor assembly into the slot.

12. A tube bundle device comprising:

a tube bundle having a plurality of elongated tubes;

an anchor assembly located within the tube bundle, wherein the plurality of elongated tubes are arranged in rows, each elongated tube is substantially U-shaped having a first elongated tube portion that extends along one side of the tube bundle, a U-bend portion, and a second elongated portion that extends along another side of the tube bundle, wherein the anchor assembly is positioned adjacent the U-bend portion; and at least one tube support device, wherein each tube support device comprising:

an elongated longitudinally extending generally planar strip having a pair of opposing faces;

a plurality of tube engaging members extending from the pair of opposing faces, wherein the tube support device is sized such that the support device is located between adjacent rows of elongated tubes, wherein the plurality of tube engaging members includes a plurality of successive transverse tube support rows located at successive longitudinal locations along the strip, wherein each tube support row having a plurality of raised, tube-engaging zones, wherein at least two of the plurality of raised, rube-engaging zones extend laterally outwards from one of the pair of opposing faces and at least one of the plurality of raised, tube-engaging zones extends laterally outwards from another one of the pair of opposing faces, wherein the plurality of raised, tube-engaging zones extend laterally outwards to engage with tubes in the tube bundle on opposite sides of a tube lane, wherein at least one tube in the tube bundle is engaged by at least one raised tube engaging zone of each of at least two tube support rows of the tube support device, wherein only the raised, tube-engaging zones of the tube engaging members engage the tubes; and an engagement assembly formed on one end of the tube support device, wherein the engagement assembly engages the anchor assembly.

13. The tube bundle device according to claim 12, wherein the anchor assembly having an anchor assembly axis, wherein the engagement assembly secures the tube support device to the anchor assembly while permitting the tube support device be rotated at least partially around the anchor assembly axis such that the tube support device may be properly located within the U-bend portions of the elongated tubes.

14. The tube bundle device according to claim 12, wherein the engagement assembly comprising an aperture formed in one end of the strip, wherein the aperture being sized to receive the anchor assembly therein.

15. The tube bundle device according to claim 12, wherein the engagement assembly comprising a slot formed in one end of the strip, wherein the slot being sized to receive the anchor assembly therein.

16. The tube bundle device according to claim 15, wherein the slot having an open end, wherein the open end is tapered to facilitate insertion of the anchor assembly into the slot.

17. The tube bundle device according to claim 12, wherein the engagement assembly is formed in one end of the strip.

18. The tube bundle device according to claim 17, wherein the strip adjacent the one end is folded over onto itself to form an area of increased thickness, wherein the engagement assembly is formed in the area of increased thickness.

19. The tube bundle device according to claim 12, further comprising an extension secured to the strip, wherein the engagement assembly is formed in the extension.

20. The tube bundle device according to claim 19, wherein the engagement assembly comprising an aperture formed in one end of the extension, wherein the aperture being sized to receive the anchor assembly therein.

21. The tube bundle device according to claim 19, wherein the engagement assembly comprising a slot formed in one end of the extension, wherein the slot being sized to receive the anchor assembly therein.

22. The tube bundle device according to claim 21, wherein the slot having an open end, wherein the open end is tapered to facilitate insertion of the anchor assembly into the slot.

23. The tube bundle device according to claim 12, wherein the tube bundle device is a heat exchanger.

24. A method of reducing vibration in a heat exchanger having a tube bundle, wherein the tube bundle having a plurality of elongated tubes and an anchor assembly located within the tube bundle, wherein the plurality of elongated tubes are arranged in rows, each elongated tube is substantially U-shaped having a first elongated tube portion that extends along one side of the tube bundle, a U-bend portion that extends over an anchor assembly, and a second elongated portion that extends along another side of the tube bundle, the method comprising:

locating at least one tube support device between adjacent rows of the elongated tubes in the U-bend portion, wherein each of the at least one tube support device having an elongated longitudinally extending generally planar strip having a pair of opposing faces, a plurality of tube engaging members extending from the pair of opposing faces, wherein the tube support device is sized such that the tube support device is located between adjacent rows of elongated tubes, wherein the plurality of tube engaging members includes a plurality of successive transverse tube support rows located at successive longitudinal locations along the strip, wherein each tube support row having a plurality of raised, tube-engaging zones, wherein at least two of the plurality of raised, tube-engaging zones extend laterally outwards from one of the pair of opposing faces and at least one of the plurality of raised, tube-engaging zones extends laterally outwards from another one of the pair of opposing faces, and an engagement assembly formed on one end of the tube support device;

engaging the tube support device with the anchor assembly, wherein the anchor assembly having an anchor assembly axis; and rotating the tube support device about the anchor assembly axis to position with the tube support device in a desired location between adjacent elongated tubes in the U-bend portion, wherein the plurality of raised, tube-engaging zones extend laterally outwards to engage with adjacent tubes, wherein at least one tube in the tube bundle is engaged by at least one raised tube engaging zone of each of at least two tube support rows of the tube support device, wherein only the raised, tube-engaging zones of the tube engaging members engage the tubes.

* * * * *